US006708449B2

(12) United States Patent
Stojc

(10) Patent No.: US 6,708,449 B2
(45) Date of Patent: Mar. 23, 2004

(54) TWO MOTOR ARRANGEMENT FOR A DOOR OPERATOR

(75) Inventor: Andre Stojc, Ile Bazard (CA)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 10/135,642

(22) Filed: Apr. 30, 2002

(65) Prior Publication Data

US 2002/0194785 A1 Dec. 26, 2002

Related U.S. Application Data

(60) Provisional application No. 60/288,778, filed on May 5, 2001.

(51) Int. Cl.[7] ..... E05C 7/06; E05F 17/00; E05F 11/34

(52) U.S. Cl. ..... 49/118; 49/362

(58) Field of Search ..... 49/120, 119, 118, 49/117, 116, 362, 366, 279, 280

(56) References Cited

U.S. PATENT DOCUMENTS 4,091,570 A * 5/1978 Favrel ..... 49/118
5,483,769 A * 1/1996 Zweili ..... 49/118
6,032,416 A * 3/2000 Springer et al. ..... 49/119
6,134,838 A * 10/2000 Reddy ..... 49/362
6,209,612 B1 * 4/2001 Schack et al. ..... 49/116
6,324,789 B1 * 12/2001 Stephen ..... 49/362
6,385,910 B1 * 5/2002 Smink et al. ..... 49/120
6,446,389 B1 * 9/2002 Heffner et al. ..... 49/280
6,539,669 B1 * 4/2003 Heidrich et al. ..... 49/120

* cited by examiner

*Primary Examiner*—Hugh B. Thompson, II
(74) *Attorney, Agent, or Firm*—James Ray & Associates

(57) ABSTRACT

A tandem of independent powered door operators for passenger transit vehicles having a central lock mechanism and enabling each of the doors to be moved with a force of less than 80 N. Such door operators can be used on vehicles where the cross-sectional area within which to accommodate a door operator is limited. The door operator comprises an electric motor, a helical drive screw rotatably connected to such electric motor with a universal joint, a drive nut assembly engaged with such drive screw, a door hanger rod, a first door hanger bracket connected to a door and engaging the drive nut, a second door hanger bracket connected to a door and engaging a centrally located lock mechanism enabling locking of such door in a fully close position.

2 Claims, 3 Drawing Sheets

TWO MOTOR ARRANGEMENT FOR A DOOR OPERATOR

CROSS-REFERENCE TO RELATED APPLICATIONS

This application is related to and claims priority from U.S. Provisional Patent Application Ser. No. 60/288,778 filed on May 5, 2001 and on application Ser. No. 10/135,501, titled "Central Lock Mechanism" filed concurrently herewith. This application is also related to the invention disclosed in U.S. Pat. No. 6,032,416, titled Transit Vehicle Door". The teachings of U.S. Pat. No. 6,032,416 and co-pending application Ser. No. 10/135,501 and filed concurrently herewith are incorporated into this document by reference thereto.

FIELD OF THE INVENTION

The present invention generally relates to door hardware systems of the type typically used to operate a pair of bi-parting doors of a passenger transit vehicle. More particularly, the invention pertains to a tandem arrangement of independent door operators having a central lock mechanism.

BACKGROUND OF THE INVENTION

The following background information is provided to assist the reader to understand the environment in which the invention will typically be used. The terms used herein are not intended to be limited to any particular narrow interpretation unless specifically stated otherwise in this document.

Among the many door operators to which the invention disclosed herein relates is the door hardware system disclosed in U.S. Pat. No. 6,032,416. As can be seen in FIG. 1 of this patent there is an opening in a sidewall of a passenger transit vehicle. Fixed to, or incorporated as part of the body of, the transit vehicle above the opening is a base plate disposed just above and horizontally along the length of such opening. It is to this base plate that the door hardware system attaches to the passenger transit vehicle.

The door hardware system features a plurality of rod hangers, a motor, a drive mechanism, a door hanger rod, first and second door panels, outer and inner door hangers for the first door, inner and outer door hangers for the second door and first and second door lock assemblies for the door panels. Each of the door panels has on its inner edge a rubber-like strip that collectively serve not only as a weather seal but also as a biasing means in the manner described below.

The first and second door lock assemblies, as well as the motor, are attached to the base plate of the vehicle by means of bolts and brackets. Specifically, the motor is bolted to the base plate via an L-shaped bracket. The first door lock assembly is bracketed to base plate above the left vertical edge of the opening. Similarly, the second door lock assembly is bracketed to the base plate above the right vertical edge of the opening.

Viewed from left to right in FIG. 1, the drive mechanism includes a coupling, a drive shaft, a well known spider coupling, a first helical drive screw, a center coupling, a second helical drive screw, and first and second drive nut assemblies. Controlled by a Door Control Unit (not shown) based on various central command signals and local door hardware signals, the motor and the gear reducer unit at its right to which it is connected, is what drives the drive mechanism. The coupling couples the output shaft of a gear reducer unit to the left end of the drive shaft. The right end of the shaft is coupled to the left end of a first helix drive screw by a coupling. A center coupling couples the right end of the first screw to the left end of a second screw.

Six rod hangers are attached by bolts to the base plate of the vehicle and are used to interconnect the door hanger rod to the vehicle base plate. Located just to the right of the coupling is the first rod hanger. It features a receptacle in its lower end in which the left end of the door hanger rod is secured. Similarly, the sixth rod hanger has a receptacle in its lower end in which the right end of another door hanger rod is secured. Each of the first through fifth rod hangers has two orifices, one in its upper end and the other in its lower end. By their lower orifices, these five rod hangers are used to support the door hanger rod and the weight that door hanger rod bears. A drive shaft passes through and thus can be rotated within the upper orifice of the first rod hanger. Located just to the right of the coupling is the second rod hanger. A first screw passes through its upper orifice and is free to rotate therein. The center coupling is supported by the third and fourth rod hangers. Located just left of the center coupling is the third rod hanger. The first screw is free to rotate within its upper orifice. The fourth rod hanger is located to the right of the center coupling. A second screw passes through its upper orifice and is free to rotate therein. Located just to the left of the second door lock assembly is the fifth rod hanger. The right end of the second screw is free to rotate within its upper orifice and does not extend further to the sixth rod hanger.

Each door hanger features a lower section that takes the form of a bracket and an upper section that defines a horizontally disposed bore. By their lower brackets, outer and inner door hangers are affixed by bolts to the top corners of the first door panel. Similarly, inner and outer door hangers are affixed by bolts to the top corners of the second door panel. By their respective bores, the door hangers are each collared around a door hanger rod. In particular, the outer door hanger is collared around a rod between the first and second rod hangers. The inner door hanger is collared around a rod between the second and third rod hangers. Another inner door hanger is collared around the rod between the fourth and fifth rod hangers. An outer door hanger is collared around a door hanger rod between the fifth and sixth rod hangers. Suspended from rod by hangers, the door panels can be slid over the opening in the sidewall of the vehicle between an UNLOCK POSITION at one extreme to an OPEN POSITION at the other extreme, as explained below.

The first drive nut assembly of a drive mechanism is bolted to the top of the inner door hanger of the first door. Similarly, a second drive nut assembly is bolted to the top of an inner door hanger of he second door. First and second helical drive screws are threaded in opposite directions, with one bearing right-handed threads and the other left-handed threads, yet are configured to rotate in the same direction due to their linkage within the drive mechanism. The first nut assembly features a threaded drive nut designed to ride along the matching threads of the first screw as it is rotated. Similarly, the second nut assembly has a threaded drive nut matched to ride along the second screw as it is rotated. Because these screws bear oppositely directed threads, the first and second drive nuts travel in opposite directions along them no matter which way the motor rotates. As the inner door hanger interconnects the first drive nut and door panel, the door by its hangers will always slide along the door hanger rod in the same direction that the first drive nut is driven along the threads of first screw. Likewise, as the other inner door hanger interconnects the second drive nut and door panel, the door by its hangers will always slide along its door hanger rod in the same direction that the second drive nut is driven along the threads of second screw. The doors of the door hardware system are thus designed as bi-parting doors, with door panels closing together when the motor rotates in a closing direction and opening away from each other when it rotate in an opening direction.

Regarding the locking feature of the door hardware system, each outer door hanger has a contact bracket (not shown) attached to the top of its upper section. Atop the outer door hanger, a contact bracket (not shown) is designed to cooperate with the first door lock assembly to provide a lock for the door panel. Similarly, a second door lock assembly cooperates with a contact bracket (not shown), atop outer door hanger, to provide a lock for the other door panel. First and second door lock assemblies are mirror-symmetrical devices. Furthermore, such first and second lock assemblies may be of any conventional locking devices having pushback or non-pushback capabilities.

It is well know that electrically powered door operators for passenger transit vehicles are either mounted within interior of the vehicle structure or the exterior of said vehicle structure and operate in a harsh environment comprising moisture, dirt, dust and, more particularly, brake shoe dust produced during multiple braking cycles. Door operator mounted on the exterior of the vehicle structure, as relates to the present invention, must operate in even harsher environmental conditions including dust and dirt generated inside the tunnels and, more particularly, extremely old and outdated tunnel structures. Consequently, such door operators must overcome various environmental disadvantages and exhibit a predetermined level of performance parameters. Additionally, these door operators must overcome a higher degree of misalignment due to the vehicle structure deflection in combination with a restricted space envelope. As the result, specific Transit Agencies promulgate unique specifications for the design and operation of the passenger transit door system, namely:

1. Fit in a maximum cross-section space envelope of 110 mm (Height)×85 mm (Depth)
2. Achieve low door free running force of 80 N maximum. Door free running force to be taken with power down but every door mechanism components still connected to the door.
3. Mounting on the outside the vehicle structure under a simple cover in a very dusty environment related to old tunnels.
4. Utilize door hanger system having sealed linear bearing with minimum 5 years between lubrication.
5. Utilization of door operator mechanisms having a helix drive screw directly driven by an electric rotary prime mover.

The aforementioned low door running forces are essential to allow for consistency of door closing and door opening times and ease of manual operation in case of the emergency. Such low door running forces are in direct correspondence to the total door system frictional forces. To ensure a minimum lubrication period of 5 years, linear bearing seals disposed at each end of the bearing housing generate a friction of approximately 50 N per door panel. Additional friction is generated due to:

1. Door bottom roller and guide;
2. Efficiency of drive screw mechanism; and
3. Back driving of the motor/gear box assembly.

Furthermore, it is well known that Transit Agencies specify a life cycle test, and door systems which do not meet the life cycle test cannot be sold for use on passenger transit vehicles operated by such Transit Authorities.

To meet such life cycle test requirements, the standard door operators had to be modified as it was found that the components thereof, such as seals disposed at each end of the linear bearings having housing that generate friction of less than 50 N per door wore prematurely or were damaged, or that re-lubrication had to be performed sooner than the specified 5 year period.

It was further found that a belt driven door operator would be more capable of meeting low door free running forces by having a greater efficiency than the helix drive screws, however a change in specification would have been required to permit the use of such door operators. Attempts were also made to utilize a larger electric prime mover to overcome higher frictional forces, but the size of such electric prime movers exceeded the available space envelope.

As it can be seen from the above discussion, it would be advantageous to have an electrically powered door operator that has a low door running force and enables at least 5 years between lubrication.

Aforementioned U.S. Pat. No. 6,032,416 teaches an overhead linear operator which has several advantages over the currently used door operators. However, based upon data collected on the initial design of the door operator of U.S. Pat. No. 6,032,416 (hereby referred to as Design I), it was determined that the design would not meet some of the design input criteria for a door system.

The door operator of the present invention improves upon the design I overhead linear door operator in that it meets all of the design input criteria for operation as set forth above.

SUMMARY OF THE INVENTION

The present invention provides a tandem arrangement of powered door operators for a bi-parting door arrangement having a central door lock arrangement enabling each of the doors to be moved with a force of less than 80 N. The door operator comprises an electric motor disposed at one end of the door operator and connected to a helical drive screw aligned substantially parallel to door drive direction with a universal joint arrangement. At the other end, such helical drive screw is engaged with a spherical bushing disposed within a second door operator mounting bracket. A drive nut assembly engages the helical drive screw in order to be driven thereby in a linear direction upon rotation of such drive screw enabled by the electric motor. A pair of door hanger bracket assemblies is connected to a door for driving such door in a drive direction upon rotation of such helical drive screw. The door hanger bracket assemblies are collared around a drive rod disposed substantially parallel to the driving direction. The first door hanger bracket assembly provides rotational constraint in order to prevent the drive nut from rotating about an axis of such helical drive screw. Such door hanger bracket assembly further providing linear constraint of such drive nut along such axis of such drive screw between such drive nut and such driven component so that rotation of such drive screw causing motion of such drive nut parallel to such axis of such drive screw causes movement of such driven component parallel to such drive direction. The second door hanger bracket assembly engages a centrally disposed lock mechanism for locking such door in a substantially closed position. The universal joint in combination with a spherical bushing enables the helical drive screw to be misaligned to a maximum of 10 degrees due to the vehicle structure deflection without increase in friction.

OBJECTS OF THE INVENTION

It is, therefore, a primary object of the present invention to provide a door operator that features lower free door running forces thereby allowing the door panels to be moved with a lesser force.

It is another object of the present invention to provide a door operator that provides a re-lubrication period of not less than 5 years.

It is an additional object of the present invention to provide a door operator that allows for drive screw misalignment without affecting the free door running forces.

In addition to the objects and advantages listed above, various other objects and advantages of the invention will become more readily apparent to persons skilled in the relevant art from a reading of the detailed description section of this document. The other objects and advantages will become particularly apparent when the detailed description is considered along with the attached drawings and with the appended claims.

DETAILED DESCRIPTION OF THE INVENTION

Figure 1:
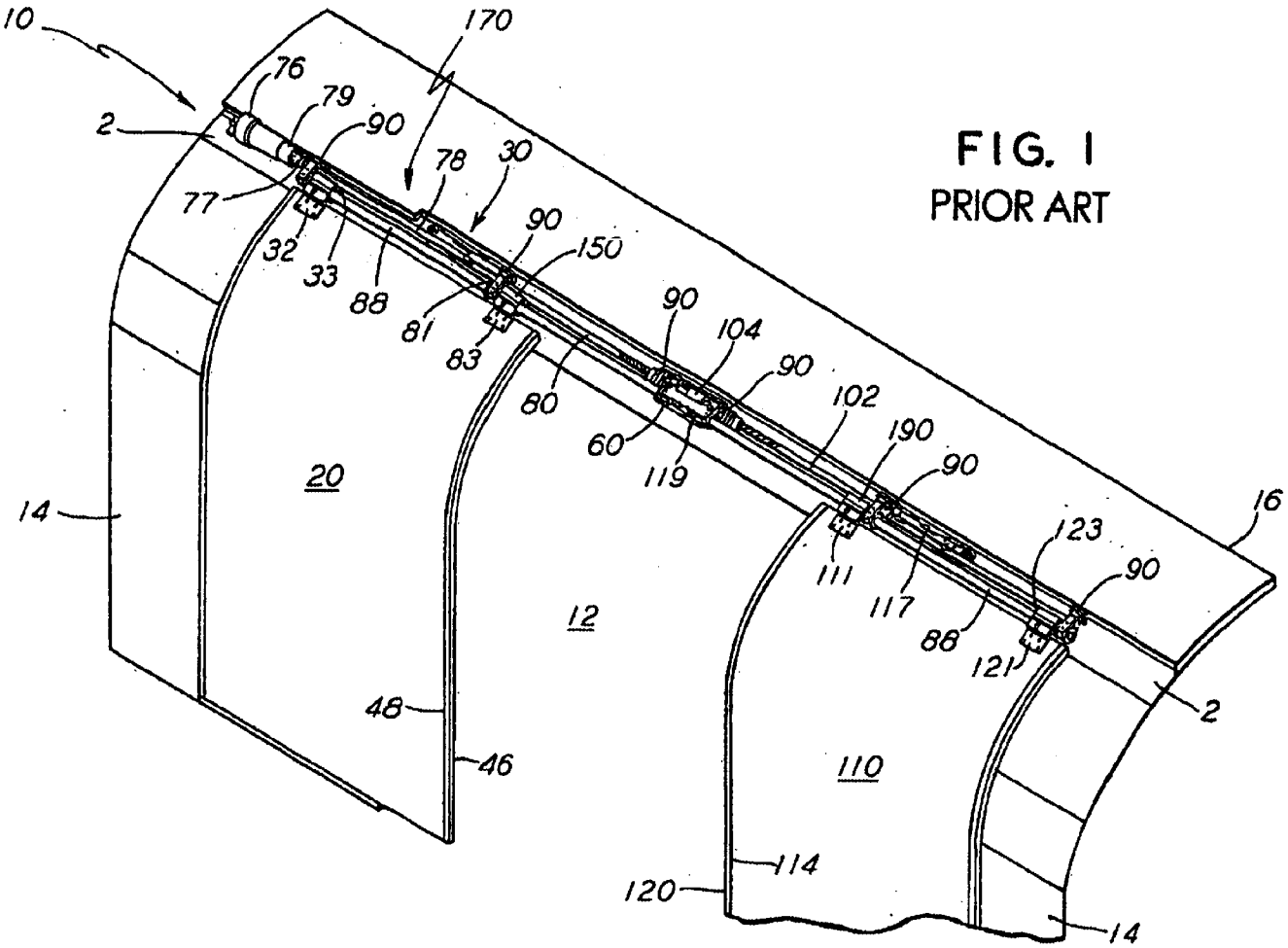
FIG. 1 PRIOR ART
FIG. 1 is a perspective view of one type of prior art door operator installed over a doorway whose doors are shown open.

Before describing the invention in detail, the reader is advised that, for the sake of clarity and understanding, identical components having identical functions have been marked where possible with the same reference numerals in each of the Figures provided in this document.

Figure 2:
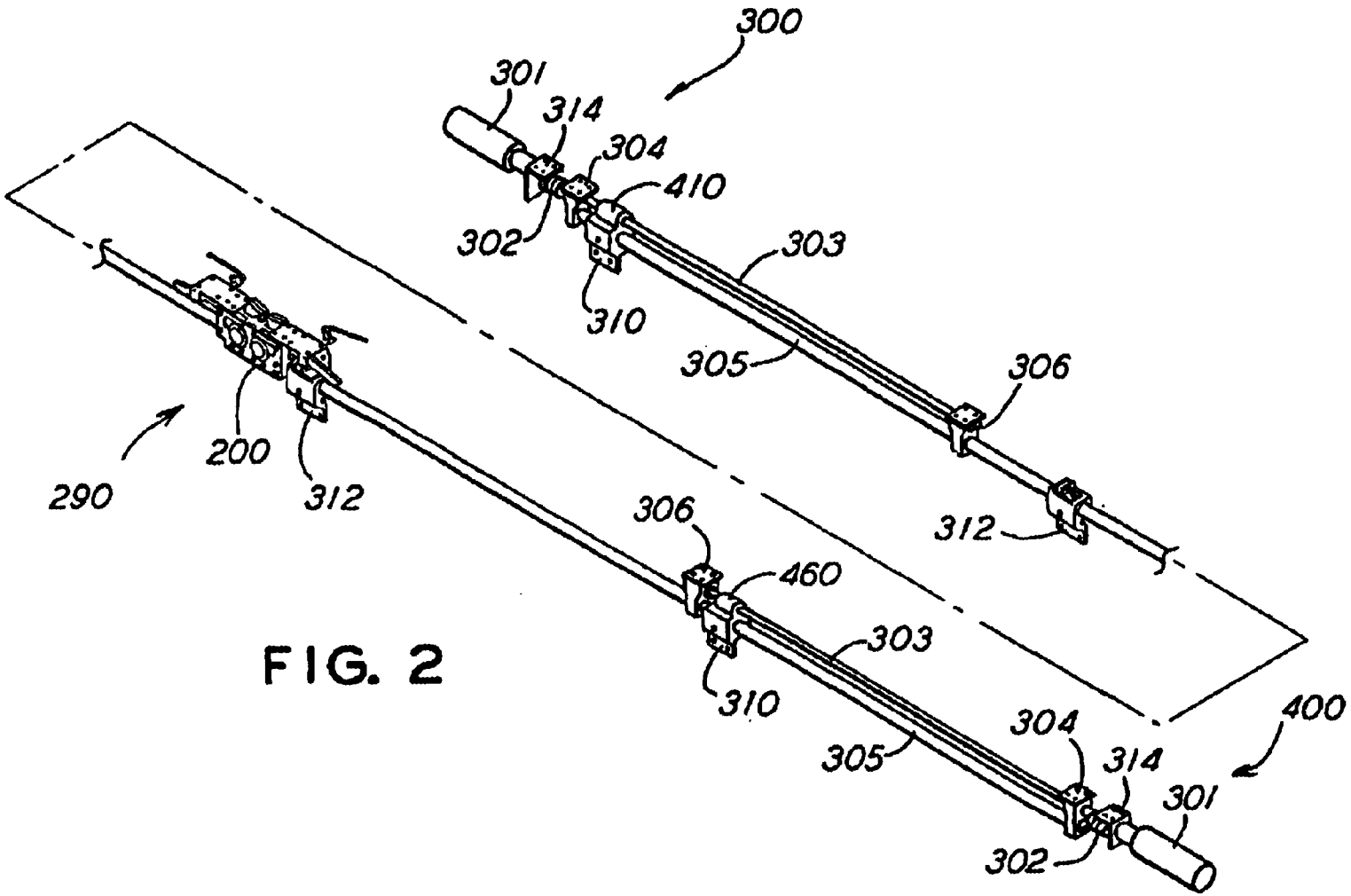
FIG. 2 is a perspective view of a door operator, according to the present invention, featuring a tandem operator arrangement for operating each of the door panels independently, a central lock mechanism and the other components of a novel drive mechanism.

FIG. 2 illustrates a tandem powered door operator arrangement, generally designated 290, of the present invention that comprises a left hand door operator, generally designated 300 and a right hand door operator, generally designated 400, having a centrally located lock mechanism 200 enabling locking of both doors 20 and 110 (FIG. 1) in a full closed position. The door operators 300 and 400 are essentially mirror images of each other. Therefore, only door operator 300 is described hereinafter.

The door operator 300 includes an electric motor 301 rotatably connected to a helical drive screw 303 with a universal joint 302 at one end of door operator 300. A drive nut 410 engages such helical drive screw 303 to be driven thereby upon rotation of such helical drive screw 303 enabled by the electric rotary motor 301. Additionally, drive nut 410 engages first door hanger bracket 310 collared around a drive rod 305 and substantially connected to the first door 20, for driving such first door 20 to cover and uncover the opening 12 (FIG. 1). Furthermore, any drive nut having low frictional forces would be suitable for this application.

Figure 3:
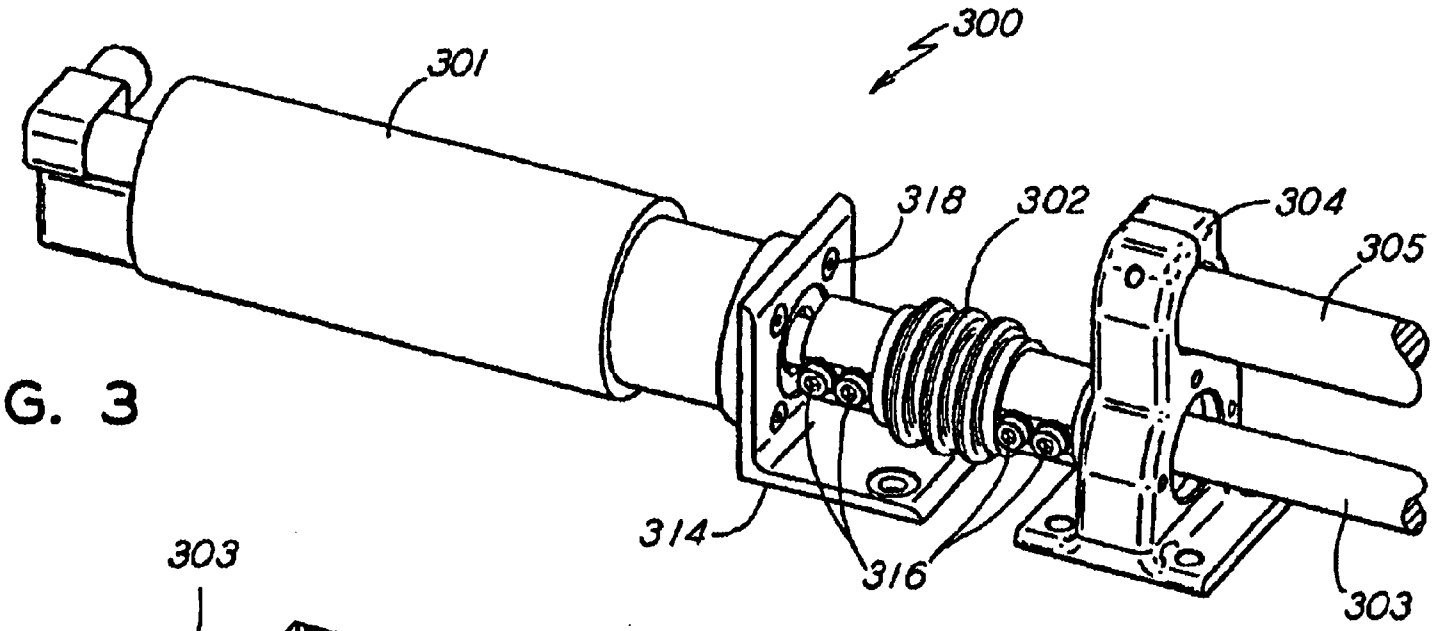
FIG. 3 is a perspective view of the door operator, according to the invention, particularly showing the connection between the motor and the drive screw.

As best shown in FIG. 3, electric motor 301 is substantially connected to mounting bracket 314 with a plurality of threaded fasteners 318 for attachment to the vehicle structure (not shown). A universal joint 302 is attached to the electric motor 301 at one end and to the helical drive screw 303 at the other end with well known threaded fasteners 316. A first mounting bracket 304 engages one end of the drive rod 305 for attachment to the vehicle structure (not shown).

Figure 4:
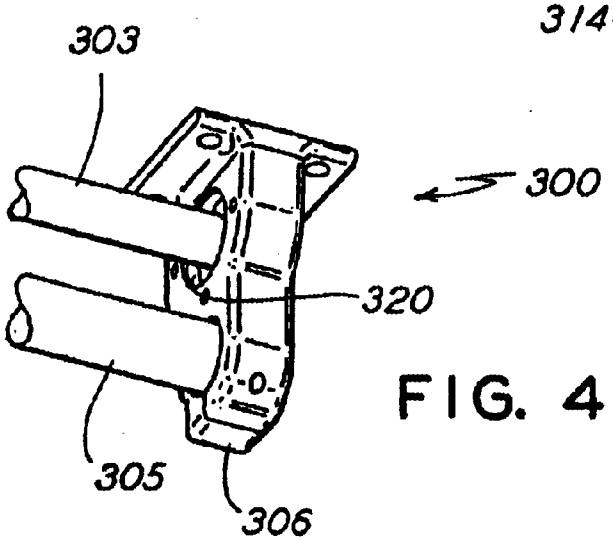
FIG. 4 is a perspective view of the door operator, according to the invention, particularly showing support of the drive screw at the distal end.

As best shown in FIG. 4, the helical drive screw 303 is engaged with the a spherical bushing 320 disposed within second mounting bracket 306, allowing for such helical drive screw 303 to expand longitudinally during door 20 or door 110 movement. The universal joint 302 in combination with spherical bushing 320 allows helical drive screw 303 to be misaligned to a maximum of 10 degrees due to the vehicle structure deflection without increase in friction. In the standard operators a well known spider type coupling connects the electric motor and helical drive member for rotational movement thereof would bind and increase friction when subjected to a 10 degree misalignment.

In further reference to FIG. 2, the first door hanger bracket assembly 310 provides rotational constraint in order to prevent the drive nut 410 from rotating about an axis of such helical drive screw 303. Such first door hanger bracket assembly 310 further provides linear constraint of such drive nut 410 along such axis of such helical drive screw 303 so that rotation of such helical drive screw 303 causing motion of such drive nut 410 parallel to such axis of such helical drive screw 303 further causes movement of door 20 to cover and uncover opening 12.

The door operator 300 further includes a second door hanger bracket 312 connected to door 20. Such door hanger bracket 312 is capable of engagement with the central lock mechanism 200. At least one linear bearing (not shown) of a recirculating ball type is disposed within each door hanger bracket 310 and 312. These linear bearings having seals (not shown) which engage the drive rod 305, such seals ensuring a minimum re-lubrication period of five years.

A central lock mechanism 200 disposed substantially adjacent the door operator 300 is capable of locking door 20, as is disclosed in U.S. patent application Ser. No. 10/135,501, filed concurrently herewith. The teachings of that utility application are incorporated into this document by reference thereto.

In the aforementioned U.S. Pat. No. 6,032,416 teaching an overhead linear operator having one electric motor 301 driving two doors 20 and 110, manual pushback movement of first door 20 would result in the movement of the second door 110 through its connecting linkage causing the total friction to exceed 160 N.

In the present invention, the door operator 300 provides lower door free running force. By having one electric motor 301 driving a single door 20, manual pushback movement of the door 20 would not result in movement of the second door 110 thus resulting in the total friction of less than 80 N, including the friction losses due to the door bottom roller, guide (not shown) and the efficiency of drive screw mechanisms 303 and drive nut 410. Furthermore, such door operator 300 meets the aforementioned criteria for maximum cross-sectional space envelope of 85 mm (depth)×110 mm (height) by engaging a centrally mounted lock mechanism 200.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art of transit vehicle drive nut without departing from the spirit and scope of the invention as set forth in the appended claims.

I claim:

1. A powered door operator attached to a first door for driving said first door in a first drive direction to cover and uncover an aperture of a transit passenger vehicle, said door operator comprising:

(a) a first electric rotary prime mover;

(b) a first helical drive screw having an axis aligned substantially parallel to said first drive direction of said first door;

(c) a first universal joint engaging said first helical drive screw at one end thereof, said first universal joint rotatably connecting said first helical drive screw with said first electric rotary prime mover;

(d) a first drive nut assembly engaged with said first helical drive screw in order to be driven thereby in said first drive direction upon rotation of said first helical drive screw enabled by said first electric rotary prime mover;

(e) a first drive rod disposed longitudinally within said door operator, said first drive rod aligned substantially parallel to said first drive direction;

(f) a first door hanger bracket assembly having a first linear bearing collared around said first drive rod, said first door hanger bracket assembly connected to said first door for driving said first door in said first drive direction upon rotation of said first helical drive screw, said first door hanger bracket assembly providing rotational constraint in order to prevent said first drive nut from rotating about said axis of said first helical drive screw, said first door hanger bracket assembly further providing a linear constraint of said first drive nut along said axis of said first helical drive screw between said first drive nut and said first door so that rotation of said first helical drive screw causing motion of said first drive nut parallel to said axis of said first helical drive screw causes movement of said first door parallel to said first drive direction;

(g) a second door hanger bracket assembly having a second linear bearing collared around said first drive rod, said second door hanger bracket assembly connected to said first door for driving said first door in said first drive direction upon rotation of said first helical drive screw;

(h) a first mounting bracket engaging said first drive rod at one end thereof for mounting to a vehicle structure;

(i) a second mounting bracket engaging said first drive rod at a distal end thereof for mounting to said vehicle structure;

(j) a door lock assembly disposed substantially adjacent said second mounting bracket, said door lock assembly engaging said second door hanger bracket assembly for locking of said first door in a full closed position; and (k) a first spherical bushing engaging said first helical drive screw at said distal end thereof, said first spherical bushing disposed within said second mounting bracket.

2. A door operator according to claim 1, further comprising:

(a) a second electric rotary prime mover;

(b) a second helical drive screw having an axis aligned substantially parallel to a second drive direction of a second door, said second door disposed substantially planar to said first door within said aperture, said second drive direction of said second door is substantially collinear with said first drive direction of said first door;

(c) a second universal joint engaging said second helical drive screw at one end thereof, said second universal joint rotatably connecting said second helical drive screw with said second electric rotary prime mover;

(d) a second drive nut assembly engaged with said second helical drive screw in order to be driven thereby in said second drive direction upon rotation of said second drive screw enabled by said second electric rotary prime mover;

(e) a second drive rod disposed longitudinally within said door operator, said second drive rod aligned substantially parallel to said second drive direction of said second door;

(f) a third door hanger bracket assembly having a third linear bearing collared around said second drive rod, said third door hanger bracket assembly connected to said second door for driving said second door in said second drive direction upon rotation of said second helical drive screw, said third door hanger bracket assembly providing rotational constraint in order to prevent said second drive nut from rotating about said axis of said second helical drive screw, said third door hanger bracket assembly further providing linear constraint of said second drive nut along said axis of said second helical drive screw between said second drive nut and said second door so that rotation of said second helical drive screw causing motion of said second drive nut parallel to said axis of said second helical drive screw causes movement of said second door parallel to said second drive direction;

(g) a fourth door hanger bracket assembly having a fourth linear bearing collared around said second drive rod, said fourth door hanger bracket assembly connected to said second door for driving said second door in said second drive direction upon rotation of said second helical drive screw, said fourth door hanger bracket assembly engaging said lock assembly for locking said second door in said full closed position;

(h) a third mounting bracket engaging said second drive rod at one end thereof for mounting to said vehicle structure;

(i) a fourth mounting bracket engaging said second drive rod at a distal end thereof for mounting to said vehicle structure; and (j) a second spherical bushing engaging said second helical drive screw at said distal end thereof, said second spherical bushing disposed within said forth mounting bracket.

* * * * *